United States Patent [19]
Cannavo' et al.
[11] 4,354,432
[45] Oct. 19, 1982

[54] HOT-WIRE IGNITION INITIATOR FOR PROPELLANT CHARGES

[75] Inventors: Christian G. Cannavo'; Andre' Espagnacq, both of Bourges; Marie L. Riffault, Sancerre, all of France

[73] Assignee: Etat Francais represente par le Delegue General pour l'Armement, Paris, France

[21] Appl. No.: 84,673

[22] Filed: Oct. 15, 1979

[30] Foreign Application Priority Data

Oct. 13, 1978 [FR] France ..... 78 29210

[51] Int. Cl.[3] ..... F42B 3/10
[52] U.S. Cl. ..... 102/202.7
[58] Field of Search ..... 102/28 R, 28 EB, 28 WB, 102/202.7, 322

[56] References Cited

U.S. PATENT DOCUMENTS

| | | | |
|---|---|---|---|
| 3,227,083 | 1/1966 | Moses et al. | 102/28 R |
| 3,264,989 | 8/1966 | Rucker | 102/28 R |
| 3,570,403 | 3/1971 | Hawley et al. | 102/28 R |
| 3,640,222 | 2/1972 | Graham | 102/28 R X |
| 3,882,323 | 5/1975 | Smolker | 102/28 R |
| 4,190,413 | 2/1980 | Shaffer et al. | 102/28 R X |
| 4,239,005 | 12/1980 | Simmons | 102/28 R |

FOREIGN PATENT DOCUMENTS

| | | | |
|---|---|---|---|
| 762710 | 7/1967 | Canada | 102/28 R |
| 2506055 | 8/1976 | Fed. Rep. of Germany | 102/28 R |

*Primary Examiner*—Peter A. Nelson
*Attorney, Agent, or Firm*—Stevens, Davis, Miller & Mosher

[57] ABSTRACT

The invention relates to a hot-wire ignition initiator for propellant charges for artillery and rockets.

This initiator comprises a housing 1 provided with an open cavity 2 within which there is arranged a filament 3 and a pyrotechnic cell composed: (a) of an initiator pyrotechnic composition 5 formed of an oxidant and a reducer, which composition is arranged in intimate contact with the filament, the coefficient of sensitivity to impact of which is at least equal to 100 joules, the coefficient of sensitivity to friction of which is at least 100 N, the coefficient of sensitivity to static electricity of which is about 16 millijoules and the ignition temperature of which is between 250° and 350° C.; (b) of an ignition pyrotechnic composition 6 formed of at least one oxidant and one reducer, which composition is arranged in the vicinity of or in contact with the initiator composition, this ignition composition having a coefficient of sensitivity to impact of at least 100 joules, a coefficient of sensitivity to friction of at least 300 N, a coefficient of sensitivity to static electricity of about 500 millijoules, and an ignition temperature of between 400° and 750° C.

11 Claims, 3 Drawing Figures

HOT-WIRE IGNITION INITIATOR FOR PROPELLANT CHARGES

Figure 1:
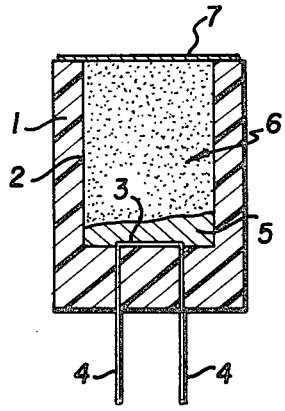

The present invention refers to electropyrotechnic ignition devices for propellant charges for artillery and rockets or light and smoke devices such as, for instance, illuminating, tracer, fumigenic, incendiary and gas-generating missiles.

At present there are two types of electric igniters, the resistant-wire systems and the conductive-substance systems.

The resistant-wire systems are igniters in which a filament or pseudo-filament is arranged within a heat-sensitive pyrotechnic substance. Among the resistant-wire systems one distinguishes between hot-wire cells and exploded-wire cells.

The conductive-substance systems are igniters in which the current conducting element is formed of the pyrotechnical substance itself; this substance may be conductive due to the addition of various powders.

The hot-wire electropyrotechnic cells require the use of products which are sensitive to the heat produced by the passage of a current through the filament. The pyrotechnic charge contained in an electric igniter of this type is customarily ignited by means of a certain amount of primary explosive arranged around the priming wire of the initiator either in the form of a compressed powder or in the form of a match-head bead. The drawbacks of these igniters are on the one hand their sensitivity to impact and friction which confers upon the components certain risks from the standpoint of safety and use, and on the other hand reside in the dangers inherent in the handling of the primary explosive.

The conductive-substance cells are of a simpler design but their principle of operation is identical, namely that when the electric energy expended makes it possible to reach the ignition temperature of the pyrotechnic product having a base of primary explosive, the igniter operates by giving off a thermal and gaseous flow. The conductive-substance cells therefore afford the same drawbacks as the hot-wire cells with in addition the fact that the operating energies are difficult to control, which also is counter-productive to safety.

In the exploded-wire cells, the pyrotechnic substance is placed in operation by the explosion of the filament, which phenomenon requires a substantial contribution of electric energy far greater than that necessary in the case of the igniting of the hot-wire cells. In view of the large amount of energy employed in this manner of initiation, one can employ less sensitive pyrotechnic mixtures which ignite difficultly under the action of low sources of energy but readily in the case of sufficiently high energies or electrical currents. Such compositions are definitely less sensitive than those used in the preceding systems. Accordingly, the exploded-wire cells are satisfactory from a standpoint of safety but the limitations resulting from volume, mass and complexity of the associated electric source make the system of initiation unusable in numerous devices.

The object of the present invention is to provide a device of the type in question which makes it possible to overcome the said disadvantages.

The invention concerns the development of an electropyrotechnic igniter which operates with a limited amount of electric energy and does not contain pyrotechnic substances which are sensitive to external mechanical forces, thermal effects, or an electrostatic or electromagnetic environment.

The object of the invention is a hot-wire ignition device comprising:

A housing having an open cavity

A filament arranged in this cavity

A pyrotechnic cell composed on the one hand of an initiating pyrotechnic composition formed of at least one oxidant and one reducer, arranged in intimate contact with the filament the coefficient of sensitivity to impact of which is at least equal to 100 joules, the coefficient of sensitivity to friction of which is at least 100 N, the coefficient of sensitivity to static electricity is about 16 millijoules and the ignition temperature of which is between 250° and 350° C. and, on the other hand, of an igniter pyrotechnic composition formed of an oxidant and a reducer, arranged in the vicinity of or in contact with the initiator composition, this igniter composition having a coefficient of sensitivity to impact of at least 100 joules, a coefficient of sensitivity to static electricity of about 50 millijoules, and an ignition temperature of between 400° and 750° C.

The initiator pyrotechnic composition is formed by the combination of a zirconium powder, a lead-chromate powder and silicone resin in accordance with the weight percentages of 40–80%, 18–60% and 2–8% respectively, and preferably 57%, 38% and 5% of RTV resin marketed by RHONE-POULENC.

The igniter pyrotechnic composition is formed by the combination of an aluminum powder, a copper-oxide powder and possibly a nitro-polymer in accordance with the weight percentages of 15–60%, 40–85%, and 0–12% respectively, and preferably 40%, 60% and 0% respectively.

The pyrotechnic cell is formed by the combining of the initiator pyrotechnic composition and the igniter pyrotechnic composition in the percentages of 5–15% and 85–95% respectively and preferably 13% and 87% respectively.

The ignition initiator is characterized by the fact that the filament is arranged at the bottom of the cavity of the housing, its ends being extended by insulating pins which pass through the housing and can be connected to a source of electricity.

Another characteristic of the invention resides in the fact that the housing is formed of an insulating material, the filament being arranged at the bottom of the cavity of the housing and being connected to a coil turn induced by an electromagnetic field which is integrated in the housing.

In accordance with another embodiment, the housing is formed of an inert or pyrotechnically active combustible material, for instance having a base of nitrocellulose, the active housings being capable of undergoing ignition without detonation by means of a 30 g tablet of hexogen.

Figure 2:
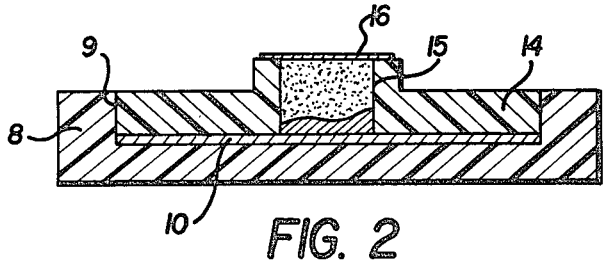
Figure 3:
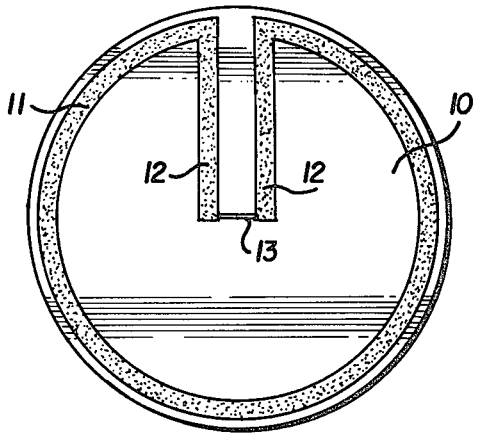

In order that the object of the invention may be better understood, two embodiments shown in the accompanying drawings will now be described by way of illustration and not of limitation. In the drawings:

FIG. 1 shows an initiator in accordance with the invention, the filament of which is connected directly to a source of electricity, FIG. 2 shows a hot-wire initiator operating by electromagnetic induction, FIG. 3 shows the induced turn and the wire which are arranged in the initiator shown in FIG. 2.

In accordance with one embodiment (FIG. 1) the initiator comprises a housing 1 having an open cavity 2 within which there is arranged the pyrotechnic cell and the filament 3 which is heated upon the firing. The pins 4, which are insulated from each other, extend through the bottom of the housing and are connected to the ends of the filament 3. These pins 4 are intended to be connected with a source of electricity, not shown. The pyrotechnic cell is formed of an initiator pyrotechnic composition 5 and by an igniter pyrotechnic composition 6. A layer of a few tenths of a millimeter, namely about 25 to 30 mg (sic), of initiator composition 5 consisting of the combination of zirconium powder, lead-chromate powder and silicone resin RTV 20521 acting as binder and phlegmatizer is arranged in the condition of a paste on the filament. The percentages by weight of zirconium powder, lead chromate powder and resin RTV 20521 are 57%, 38%, and 5% respectively. The ignition temperature of this composition is on the order of 320° C. Furthermore, it has a coefficient of sensitivity to impact of 32% initial, under 112 joules. This measure of the coefficient of sensitivity to impact, like the following ones, was determined by method FMD 410 Bl of the STPE manual of operating procedures; the measurement is effected on basis of the fall of a given weight falling from a variable height onto a sample, introduced in small amount into a capsule of special shape. The coefficient of sensitivity to friction of this composition is 118 N, which measurement is determined, like the following ones, by method FMD 420 A of the aforementioned manual, which uses the JULIUS PETERS (BAM) apparatus. Moreover, an energy of about 16 millijoules (discharge of a 100 picofarad capacitor charged under 18 kilovolts) is not sufficient to cause the ignition of the substance by spark. This latter measurement, like the following ones, was effected by arranging the pyrotechnic substance between two electrodes connected to a battery of capacitors. The upper electrode is of spherical shape of a diameter of 10 mm, the lower electrode being cylindrical and having a diameter of 2 mm. An insulating cup has a frustoconical housing in which the pyrotechnic substance to be tested is placed without tamping. The angle at the apex of the conical frustum is 90°, the diameter of the largest section is 5.5 mm and the lower electrode is flush with the smaller section of diameter of 2 mm.

This thin layer of pyrotechnic compositon, acting as match, when it is dry is covered by a layer of igniter pyrotechnic composition formed of a combination of aluminum powder and copper-oxide powder in weight percentages of 40% and 60% respectively. This mixture has an ignition temperature on the order of 550° C., a coefficient of sensitivity to impact of 112 joules, a coefficient of sensitivity to friction of 335 N, a coefficient of sensitivity to static electricity of about 50 millijoules (1000 $\mu$F capacitor charged under 10 kV). In this example, there were used about 200 mg of igniter pyrotechnic composition compressed at 300 bars, which gives the initiator an ignition powder which is more than sufficient effectively to ignite black powder of type PN L 1, placed a few millimeters away in a bag of aerated fabric. The opening of the cavity 2 of the housing is closed by a disk 7 of heavy paper which is glued and varnished, so as to isolate the pyrotechnic cell from the outside.

Another embodiment (FIG. 2) is an initiator the order of firing of which is effected by induction of a high-frequency signal of high power, which affords the advantage over the conventional electric initiators of not requiring any direct connection to the circuit of the filaments; this feature makes it possible to retain intact the intrinsic characteristics of the initiator from the standpoint of electrical safety, since the direct addition of conductors can—by causing an antenna effect—pick up electrostatic or electromagnetic energy and sensitize the system with respect to these risks.

This particular embodiment is formed of a housing 8 of inert or active insulating material. This housing has a cavity 9 within which there is arranged a disk 10 (FIGS. 2 and 3) on which there is held an induced turn 11 whose ends 12 extend up to the vicinity of the center of the disk, on which ends a filament 13 is soldered. The disk 10 is held at the bottom of the cavity 9 of the housing 8 by a cover 14 made of the same material as the housing 8. This cover 14 is fitted to the side surface of the cavity 9 and can, for instance, be secured there by gluing. Moreover this cover has a hole 15 opening onto the filament 13. This hole 15, in the same way as in the embodiment previously described, is filled with the pyrotechnic cell and is closed by a disk 16 of strong paper.

We claim:

1. Hot-wire ignition initiator characterized by the fact that it consists of:

a housing having an open cavity a filament arranged in said cavity a pyrotechnic cell composed:

of an initiator pyrotechnic composition formed of at least one oxidant and one reducer, said composition being arranged in intimate contact with the filament, the coefficient of sensitivity to impact of which is at least equal to 100 joules, the coefficient of sensitivity to friction of which is at least 100 N, the coefficient of sensitivity to static electricity of which is about 16 mullijoules and the ignition temperature of which is between 250° and 350° C.;

of an igniter pyrotechnic composition formed of at least one oxidant and one reducer, which composition is arranged in the vicinity of or in contact with the initiator composition, said igniter composition having a coefficient of sensitivity to impact of at least 100 joules, a coefficient of sensitivity to friction of at least 300 N, a coefficient of sensitivity to static electricity of about 50 millijoules and an ignition temperature of between 400° and 750° C.

2. An ignition initiator according to claim 1, characterized by the fact that the initiator pyrotechnic composition is formed by the combination of a zirconium powder, a lead-chromate powder and silicone resin in accordance with the weight percentages of 40 to 80%, 18 to 60%, and 2 to 8% respectively.

3. An ignition initiator according to claim 2, characterized by the fact that the initiator pyrotechnic composition is formed by the combination of a zirconium powder, a lead-chromate powder and silicone resin RTV 20581 in the weight percentages of 57%, 38% and 5% respectively.

4. An ignition initiator according to claim 1, characterized by the fact that the igniter pyrotechnic composition is formed by the combination of an aluminum powder, a copper oxide powder and possibly a nitropolymer in accordance with the weight percentages of 15 to 60%, 40 to 85% and 0 to 12% respectively.

5. An ignition initiator according to claim 4, characterized by the fact that the ignition composition is formed by the combination of an aluminum powder and a copperoxide powder in the weight percentages of 40% and 60% respectively.

6. An ignitiion initiator according to any of the preceding claims, characterized by the fact that the pyrotechnic cell is formed by the combination of the initiator pyrotechnic composition and the igniter pyrotechnic composition in the percentages of 5 to 15% and 85 to 95% respectively.

7. An ignition initiator according to claim 6, characterized by the fact that the pyrotechnic cell is formed by the combination of the initiator pyrotechnic composition and the igniter pyrotechnic composition in the percentages of 13% and 87% respectively.

8. An ignition initiator according to any of claims 1-5, characterized by the fact that the filament is arranged at the bottom of the cavity of the housing, its ends extending through insulated pins passing through the housing, which can be connected to a source of electricity.

9. An ignition initiator according to any of claims 1-5, characterized by the fact that the housing is formed of an insulating material, the filament being arranged at the bottom of the cavity of the housing and being connected to a coil turn induced by an electromagnetic field which is integrated in the housing.

10. An ignition initiator according to any of claims 1-5, characterized by the fact that the housing is formed of a combusible material.

11. An ignition initiator according to claim 9, characterized by the fact that the induced coil turn is arranged between the housing and a cover which contains the pyrotechnic cell.

* * * * *